US005224528A

United States Patent [19]

Helmut et al.

[11] Patent Number: 5,224,528

[45] Date of Patent: Jul. 6, 1993

[54] DEVICE AND PROCESS FOR REFILLING A CONTAINER WITH A MORE OR LESS VISCOUS MATERIAL

[75] Inventors: Ulmer Helmut, Stuttgart; Walter Hofstetter, Zumikon, both of Fed. Rep. of Germany

[73] Assignees: P H U Peter H. Unger Vertriebs GmbH; Hans Schwarzkopf AG, both of Fed. Rep. of Germany

[21] Appl. No.: 764,720

[22] Filed: Sep. 24, 1991

[30] Foreign Application Priority Data

Sep. 24, 1990 [CH] Switzerland ..... 03064/90

[51] Int. Cl.[5] ..... B65B 3/30

[52] U.S. Cl. ..... 141/353; 141/351; 141/354; 141/362; 141/1; 222/453; 222/476

[58] Field of Search ..... 141/351-354, 141/357, 360, 362, 368, 251, 253, 255, 258, 260, 266, 270, 275, 284, 1, 2, 18, 21, 25-28; 222/451, 453, 476

[56] References Cited

U.S. PATENT DOCUMENTS

| | | | |
|---|---|---|---|
| 689,468 | 12/1901 | Dobbyn | 141/353 |
| 966,270 | 8/1910 | Van Leir | 141/354 |
| 1,068,067 | 7/1913 | McPherson, Jr. | 141/353 X |
| 1,335,800 | 4/1920 | Smith | 141/353 X |
| 1,763,971 | 6/1930 | Kantor et al. | 141/353 X |
| 1,837,412 | 12/1931 | Back | 141/354 X |
| 2,168,380 | 8/1939 | Winton | 141/354 X |
| 2,601,359 | 6/1952 | Berwick | 141/353 X |
| 2,652,965 | 9/1953 | McGihon | 141/353 X |
| 2,820,579 | 1/1958 | Roth | 141/353 X |
| 4,210,262 | 7/1980 | Donaldson | 141/362 X |

FOREIGN PATENT DOCUMENTS

| | | | |
|---|---|---|---|
| 0337616 | 12/1903 | France | 222/453 |
| 1022067 | 2/1953 | France | 141/352 |
| 0448756 | 6/1936 | United Kingdom | 141/351 |
| 0805905 | 12/1958 | United Kingdom | 141/353 |
| 2173477 | 10/1986 | United Kingdom | 222/476 |

*Primary Examiner*—Henry J. Recla
*Assistant Examiner*—Casey Jacyna
*Attorney, Agent, or Firm*—Staas & Halsey

[57] ABSTRACT

The device is suited for refilling a container (2) with a more or less viscous material. The device exhibits a supporting structure (3), to which a supply container (6) is fastened and a temporary storage device (8) extending away from the supply container (6). A nozzle (12) is arranged on the end of the temporary storage device turned away from the supply container (6). The device further exhibits an outlet valve (23) on the end of the nozzle (12) turned away from the supply container (6) and encompasses a closing valve (22) arranged in the temporary storage device (8). The valves mentioned (22, 23) are opened and/or closed by a mechanical coupling by the pressing of a container to be filled (2) on a first plunger (15). Because the work of the valves is controlled purely mechanically and not by the pressure conditions prevailing in the temporary storage device, the device functions well practically independent of the viscosity of the material to be filled and performs maintenance-free over a long period of time.

11 Claims, 3 Drawing Sheets

DEVICE AND PROCESS FOR REFILLING A CONTAINER WITH A MORE OR LESS VISCOUS MATERIAL

BACKGROUND OF THE INVENTION

1. Field of the Invention

The present invention refers to a device for refilling a container with a more or less viscous material and a process for refilling a container with the device.

2. Description of the Related Art

Devices of the above mentioned type are also known on the market in a similar design under the name "proportioning, dosing, or dispensing device." A typical example has been evidenced in the German Patent Specification DE 27 17 878, for instance. It is a device for the dosed dispensing of liquids or pastes. The device consists of a chamber in a housing which can be connected to a supply container for the material to be dispensed. An elastic siphon is arranged in the chamber as a suction and pressure organ. The siphon can be operated by an operating sliding head with an external nozzle. The inside of the siphon is connected both to the supply container via an outlet valve and to the nozzle via an inlet valve. When at the rest, the inside of the siphon is filled with the material to be dispensed. Both the inlet and the outlet valve are closed, each being supported by the force of an attached spring. Pressure is exerted on the material to be dispensed through compression of the siphon by the operating sliding head. This pressure causes the outlet valves to open against the force of the corresponding spring. The dispensing material can flow out through the nozzle. By releasing the operating sliding head, the operating sliding head is pressed back into its initial position by an additional spring. The siphon expands. The valves are again for the time being in the closed state. The vacuum, created by the expansion in the siphon opens the inlet valve, upon which the dispensing material is suctioned back into the siphon from the supply container. After disappearance of the vacuum, the inlet valve is closed again by the effect of the allocated spring.

SUMMARY OF THE INVENTION

In this device, both the outlet and inlet valves are controlled exclusively by the pressure present in the siphon. The design of the valves and the dimensioning of the individual springs are not unproblematic, as explained in the above-mentioned patent specification. Thus difficulties can certainly exist so that small losses can appear at the outlet valves arranged in the nozzle or difficulties in the triggering of the inlet valve which controls the connection between the interior of the siphon and the supply container. Depending on the viscosity of the material, these difficulties are correspondingly greater for one or another valve. To reduce these disadvantages, correspondingly expensively designed valves have been suggested.

The task of the present invention is the complete elimination of the above mentioned difficulties. A device characteristic of the invention should always function equally well regardless of the viscosity of the dispensing material. The device should be able to be fabricated as simple as possible, without expensive special sets of valves.

This task is solved by a device for refilling a container with a more or less viscous material, which exhibits the features set forth in the characteristic part of the present invention. A process characteristic of the invention for refilling a container with a device according to the present invention is characterized by the steps of the process cited in the present invention.

Additional designs of the invention are cited in dependent patent claims.

The invention is particularly distinguished by the fact that in creating the device for refilling a container with a more or less viscous material, care has been taken that the valves provided in the device are not controlled by the pressure prevailing in the chamber or in a temporary storage device, as is common for the present state of technology. Instead, the valves are opened and/or closed by having the container to be refilled exert pressure on a nozzle designed for this purpose, regardless of the pressure conditions prevailing in the device, by a mechanical coupling with the container or the nozzle. The valves can be so relatively easily fabricated; there is no critical dimensioning and the device thus operates efficiently and maintenance-free for a long period of time.

BRIEF DESCRIPTION OF THE DRAWINGS

With the help of drawings, the invention is more closely described below by examples. The drawings show FIG. 1, a side view of a device characteristic of the invention, FIG. 2, a cross-section of the device in resting position according to FIG. 1 and FIG. 3, a cross-section of the device according to FIG. 1 during material dispensing for refilling a container.

DESCRIPTION OF THE PREFERRED EMBODIMENTS

Figure 1:
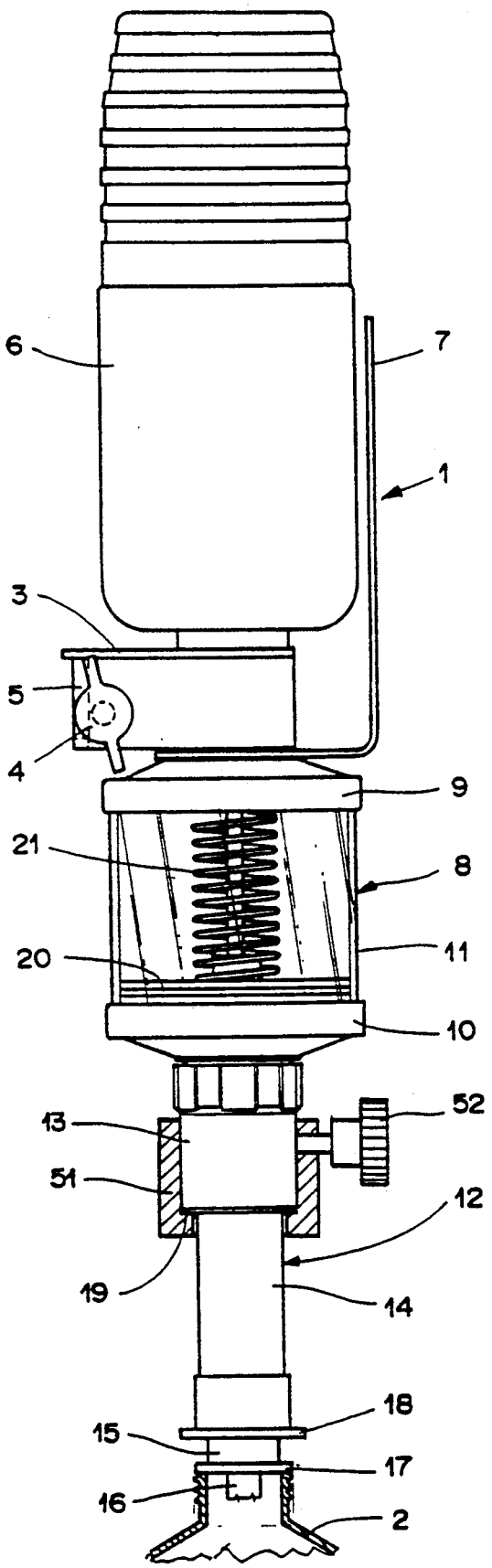

The side view illustrated in FIG. 1 of a device characteristic of the invention comprises a supporting structure 3, not described in more detail because it is of a known design, which can be fastened to a wall with a dove-tailed holder 5. The holder is meanwhile designed with a counter piece as clamp connection fastened to the wall, which can be fixed in place with a butterfly screw 4.

On supporting structure 3 is a supply container 6 with a downward pointing spout fastenable preferably with a screw coupling. A temporary storage device 8 is arranged on the side of the supporting structure turned away from the supply container 6. The temporary storage device comprises essentially a transparent, hollow cylinder shaped body 11, for example a viewing glass, which is closed off on each face with an upper flange 9 and a lower flange 10. The upper flange 9, which faces supporting structure 3, has a mechanical means to connect to the supporting structure. A plate 7 is provided between the upper flange 9 and the support structure 3, to mount a product name, for example.

A nozzle 12 is located on the lower flange 10. This comprises essentially a plunger case 14, on whose end 8, averted from temporary storage device 8, an initial plunger 15 is arranged and whose second end is connected essentially with a second plunger 20, located in temporary storage device 8. The plunger case 14 is inside an end sleeve 13, fastened to lower flange 10, adjustable lengthwise. A spring 21 for the second plunger 20, visible through viewing glass 11, provides substantially for the resting state of the nozzle 12 shown in FIG. 1.

The refilling of a container 2, which will be described in detail below, occurs essentially in that the container 2 is put over an outlet tube 16, only partially visible in this figure. The opening of the container to be filled is on a counter pressure flange 17 of the first plunger 15. The first plunger 15 is moved lengthwise during upward pressure of the container 2 relative to the nozzle 12 and/or relative to the plunger case 14, until the counter pressure flange 17 is close to the plunger case flange 18. This movement causes, as will be shown, an outlet valve arranged on outlet tube 16 to open. Upon further pressure from the container 2, the plunger case 14 begins to extend into the temporary storage device. The second plunger 20 is meanwhile moved toward the upper flange 9. This movement transports the material found in the temporary storage device through a passage in the second plunger 20 through the plunger case 14 and the outlet tube 16 into container 2. During this process, the supply container 6 is closed by a closing valve not visible in this figure. Material conveyance occurs as long as the container's pressure movement lasts. This can be limited, to prevent overfilling a container, for example, by a sleeve-shaped stopping organ 51, which is arranged for lengthwise movement on the end sleeve 13. The stopping organ 51 can basically be adjusted and fixed with a stop pin 52.

Figure 2:
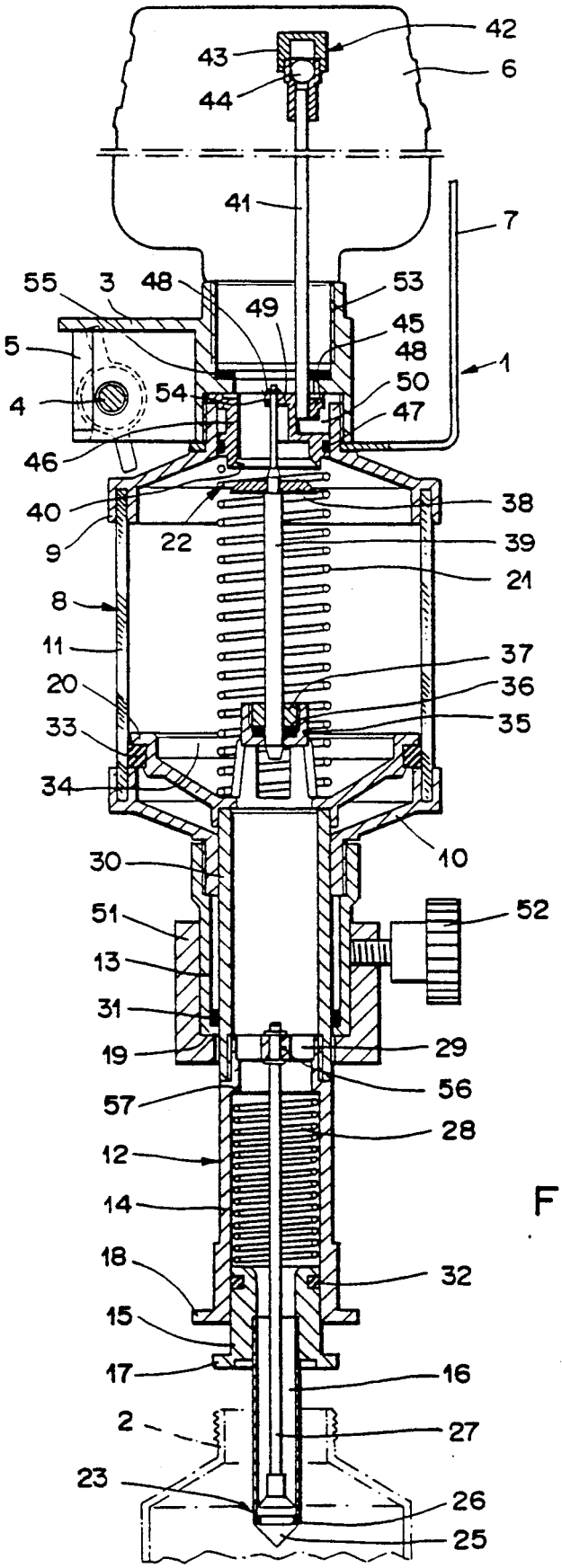
Figure 3:
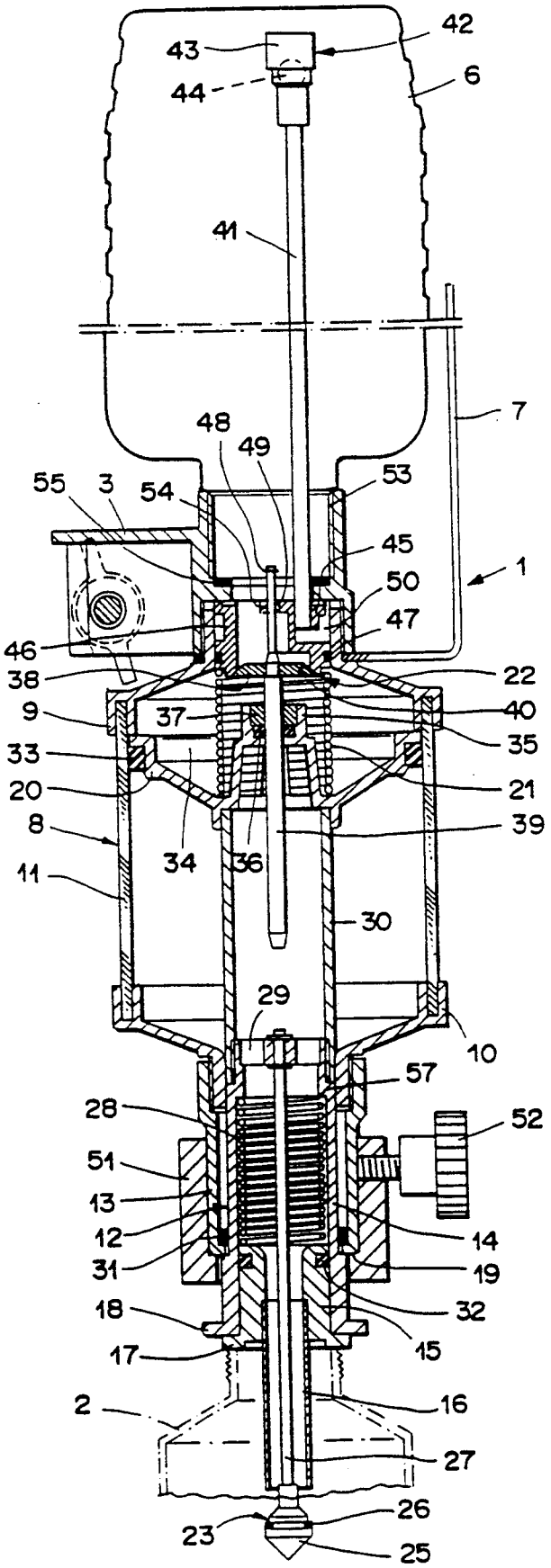

In FIGS. 2 and 3, the device characteristic of the invention for refilling a container is illustrated as a cross sectional drawing in the resting state (FIG. 2) and once each with nozzle 12 (FIG. 3) completely pressed in. Parts, already described on the basis of FIG. 1, have the same reference symbols in FIG. 2 and 3. FIG. 2 describes the mechanical arrangement of the device characteristic of the invention more closely. The spout of the supply container 6 is connected to the supporting structure 3 by a screw coupling 53. A ventilation tube 41 projects into the supply container 6. The ventilation tube extends practically across the whole length of the supply container. The ventilation tube 41 is connected with one of its ends by a supporting element 45, which is arranged in an inlet bushing 46 of the supporting structure 3. The inlet bushing 46 extends in lengthwise direction to the screw coupling 53, essentially contiguous to it, averted from the supply container 6, however, and turned to the temporary storage device 8. The supporting element 45 is, for example, designed in the shape of an eye or web 49, which projects radially into the inside from the side of the inlet bushing 46. The web 49 covers about half, the center included, of the profile of the inlet bushing 46. Connected with this web 49, by compression or soldering, the stated one is one end of the ventilation tube 41. A ventilation canal 50 forms the prolonged extension of the lower end of the stated ventilation tube and extends within the supporting element 45 to a ventilation hole, not visible in the drawing, in the supporting structure 3. The web 49 exhibits a bored hole 54 in its center, the function of which will be explained below. A ventilation valve 42 is arranged on the end of the ventilation tube 41 lying close to the upper end of the supply container 6. It comprises essentially a ventilation ball 44, which, held by a valve cap 43, which can be screwed onto the corresponding end of the ventilation tube, is guided. The ventilation valve 42 functions such that when a vacuum exists in the supply container 6, the valve ball 44 is raised by the normal air pressure in the ventilation tube 41, whereby outside air can stream into the supply container 6 through the path mentioned above.

The temporary storage device 8, particularly its upper flange 9, is connected to the support structure 3 for example, via an additional screw coupling not described in more detail. The upper flange 9, similar to the lower flange 10, essentially has a plate-shaped form. In the center of both flanges, an opening is present, which leads to a hollow cylinder-shaped prolonged extension in each. The prolonged extension of the upper flange 9 is connected to the supporting structure 3 on its outside through the screw coupling already cited, for example. The inlet bushing 46 is arranged on the inside of the prolonged extension and sealed by means of an inlet bushing seal 47 opposite the upper flange 9. An additional seal 55, arranged between the supporting structure 3 and the supply container 6, provides for the sealed closing of the supply container 6 on the supporting structure 3. The previously cited hollow cylinder shaped viewing glass 11 is let into a groove of the plate-shaped upper flange 9. The lower flange 10 closes with the lower interface of this viewing glass with a groove essentially the same. The previously cited end sleeve 13, for example, is similarly screwed onto the previously cited hollow cylinder-shaped prolonged extension of the lower flange 10. The plunger case 14 is connected with a connecting tube 30 in the area of a stopping end 19 of the end sleeve 13 (FIG. 2). The connecting tube 30 extends the plunger case 14 to the second plunger 20, which is arranged inside the temporary storage device 8. The plunger 20 is fastened onto the end of the connecting tube 30, averted from the plunger case 14. The plunger case 14 and the connecting tube 30 are arranged inside the lower flange 10 and the end sleeve 13 housed adjustable lengthwise. The inner surface of the cited hollow cylinder-shaped prolonged extension of the lower flange 10 form the first part of the support and the stopping end 19, designed as offset end of the end sleeve 13, forms an additional part of the support. The vacuum seal is guaranteed by a plunger case seal 31, which is mounted between the plunger case 14 and connecting tube 30 and the end sleeve 13 in the area of the stopping end 19.

The second plunger 20 has a similarly plate-shaped design and encompasses essentially on its periphery a plunger seal 33 which closes the plunger opposite the sealing glass 11 air-tight, and a central bushing 35 arranged in the middle of the plunger. This is connected with the plunger for example via a radially arranged restraining bar 34. The return spring 21, designed as a compression spring for the second plunger 20, operates between the inlet bushing 46 and the side of the plunger 20 averted from the plunger case 14. A ring seal 36, preferably an O-ring, is mounted in the cited central bushing 35. The ring seal can be pressed together with an adjusting screw 37. Inside the central bushing 35 and the O-ring 36 a drag link 39 extends for a closing valve 22. One end of the drag link 39 lies next to the device in the resting state (FIG. 2) in the area of the central bushing 35 and the other end crosses the described bored hole 54 of the cited bar 49 of the inlet bushing 46. The end of the inlet bushing 46 facing the supply storage device 8 is designed in a truncated cone shape as valve seating 40 of the described closing valve 22. A ventilating plate 38 in the area of this valve seating 40 fastened on the drag link 39 forms the movable organ of the closing valve mentioned. A locking washer 48, which closes off the drag link 39 via the web 49, limits lengthwise movement of the drag link 39 together with the valve plate 38. The drag link 39 is fixed by the cited ring seal 36 and the cited bored hole 54.

The first plunger 15 is arranged movable lengthwise within the stated plunger case 14 on the lower end of the plunger case 14, turned away from the temporary storage device 8 of the nozzle 12. The first plunger 15 exhibits a central bored hole, in which the outlet tube 16, which extends away from the plunger tube 14, is fastened. Further, the first plunger 15 exhibits in its retractable area within the plunger case 14, a plunger seal 32. The end of the first plunger 15 averted from the plunger case 14 encompasses the previously cited stop 17 for the container 2, which is to be filled. At the connection point of the plunger case 14 and the connecting tube 13, the first, for example, radially arranged webs 29 are exhibited, which hold an additional central bushing 56 in the center. An outlet valve rod 27, which is fastened in this additional central bushing 56, extends beyond the area of the plunger case 14, the first plunger 15 and the outlet tube 16. An outlet valve 23 is arranged on the end of the outlet valve rod 27. The outlet valve encompasses a valve closing ball 25, which is connected with the outlet valve rod 27 and an outlet valve seal 26 mounted on the valve closing ball 25. The end of the outlet tube 16 turned away from the first plunger 15 presses in the resting state, supported by an outlet valve spring 28 against the seal 26. The lengthwise movement of the first plunger 15 is in one case limited by the attachment of the cited end of the outlet tube 16 on the seal 26 and, in the other case, by the proximity of the pressure flange 17 on the plunger case flange 18, which is located, as mentioned above, on the lower end of the plunger case 14. The outlet valve spring 28 is designed as a pressure spring and operates between the end of the first plunger 15, located in plunger case 14 and an attachment 57, which has been located in the area of the end of the plunger case 14 facing the connecting tube 30.

Now that the essential components of the device characteristic of the invention have been described, a closer description of the method of functioning of a refilling process follows below.

First an empty container 2 to be filled is pushed over the outlet valve 23 and the outlet tube 16, whereby the container's inlet opening is against the counter pressure flange 17 of the first plunger 15. Upon forcing the container 2 against the pressure flange 17, the plunger 15 moves inside the plunger case 14 in lengthwise direction against the temporary storage device 8. This movement raises inlet tube 16 from the inlet valve seal 26 and opens the outlet valve 23. The first plunger 15 serves meanwhile as the first mechanical means of coupling between the container 2 and the outlet valve 23. As soon as the pressure flange 17 is against the plunger case flange 18, the plunger case 14 moves upon additional pressure of the container 2 to be filled in the direction of the temporary storage device 8. The second plunger 20, connected to the plunger case 14 via the connecting tube 30, is thus raised against the upper flange 9. The ring seal 36 in the central bushing 35 is so forcefully tightened with the adjusting screw 37 that as a result of the great friction, the drag link 39 from the second plunger 20 is taken along until the valve disk 38 of the closing valve 22 lies sealed on the valve seat 40 of the inlet bushing. The opening between the supply container 6 and the temporary storage device 8 is now closed. The ring seal 36 functions together with the adjusting screw 37 as a second mechanical means of coupling between the nozzle 12 and the closing valve 22. By further pressure from the container 2, the viscous material stored in temporary storage device 8 is transported by the additional forward movement of the plunger 20 between the radial supporting organ 34 of the second plunger 20, traversing the connecting tube 30, the plunger case 14, and the outlet tube 16, into container 2. This continues until either the second plunger 20 lines up with the upper flange 9 of the temporary storage device 8 or the plunger case flange 18 lines up with stopping organ 51, previously adjusted.

Upon removal of the filled container, the outlet valve spring 28 provides for immediate closing of the outlet valve 23. The second plunger 20, which moves back relatively slowly, provides for the opening of the closing valve 22 through the force of the return spring 21 as a result of the friction coupling between the O-ring 36 and the drag link 39. The valve disk 38 is distanced meanwhile from the valve seating 40 until the safety plate 48 on rod 49 is in line with it. As a result of a suction effect which arises in the temporary storage device 8 and the ventilation of the supply container 6 previously described, the temporary storage device 8 is filled with new material from the supply container. The device is now ready for another refilling process.

The mechanical coupling of both the outlet valve 23 and the closing valve 22 with the container 2 to be filled and/or the nozzle 12 opens and/or closes these valves regardless of the viscosity of the filling material. Expensive and critical dimensioning or adjustment of the springs is not needed. Even if the spring force varies within great limits, the device functions perfectly for a long period without maintenance providing that the spring force of the outlet valve spring 28 is smaller than the spring force of the return spring 21.

We claim:

1. A device for refilling a fill container with a more or less viscous fluid, comprising:

a temporary storage device having inlet and outlet opposite ends a supply container which can be connected to the inlet end of the temporary storage device to supply the fluid to the temporary storage device;

a nozzle capable of moving so that an inlet end of the nozzle is movable between the inlet and outlet ends of the temporary storage device;

a drag link;

an inlet plunger connected to and movable with the inlet end of nozzle, the inlet plunger having a drag link housing within which the drag link is capable of frictionally sliding;

a valve seating generally at the connection of the supply container and the temporary storage device through which the supply of fluid flows;

a valve disk mounted on the drag link and positioned so that the valve disk is capable of fitting into the valve seating for blocking passage of the fluid into the temporary storage device;

an outlet plunger movable within the nozzle in a direction which is coaxial with the direction of nozzle movement, the outlet plunger being biased to project from an outlet end of the nozzle opposite the inlet end of the nozzle;

an outlet tube through which liquid flows connected to the outlet plunger;

valve ball connected to the nozzle and being positioned in the vicinity of an outlet of the outlet tube so that when the outlet tube and the outlet plunger are at a fully biased position projecting from the outlet end of the nozzle, the outlet of the outlet tube rests on the valve ball to block passage of the fluid from the outlet tube; and a flange means connected to the outlet plunger for contacting the container to be filled so that when the container is initially pushed onto the device, the outlet plunger is moved against the bias force to separate the outlet tube and the valve ball and upon further pushing the flange means contacts the nozzle to move the nozzle with the flange means towards the inlet end of the temporary storage device to close the inlet valve.

2. The device as claimed in claim 1, wherein the drag link housing comprises a ring seal coaxial with the drag link between the drag link and the inlet plunger and an adjustable screw for tightening the ring seal to adjust the friction between the ring seal and the drag link.

3. The device as claimed in claim 1, further comprising a movement control means for limiting nozzle motion so that the inlet end of the nozzle can only move partially to the outlet end of the temporary storage device.

4. The device as claimed in claim 1, further comprising:

a ventilation tube supplied on the inlet end of the temporary storage device projecting into the supply container;

an exterior vent connected to the ventilation tube; and a valve means on an end of the ventilation tube projecting into the supply container for opening when the pressure in the supply container is less than a predetermined value to allow air from the exterior vent to enter into the supply container.

5. A device for refilling a fill container with a more or less viscous fluid, comprising:

a temporary storage device having inlet and outlet opposite ends a supply container which can be connected to the inlet end of the temporary storage device to supply the fluid to the temporary storage device;

a nozzle capable of moving so that an inlet end of the nozzle is movable between the inlet and outlet ends of the temporary storage device;

a drag link;

an inlet plunger connected to and capable of moving with the inlet end of nozzle, the inlet plunger having a central bushing:

an O-ring seal within the central bushing within which the drag link is capable of frictionally sliding;

an adjustable screw for tightening the O-ring seal to adjust the friction between the O-ring seal and the drag link;

a valve seating generally at the connection of the supply container and the temporary storage device through which the supply of fluid flows;

a valve disk mounted on the drag link and positioned so that the valve disk is capable of fitting into the valve seating for blocking passage of the fluid into the temporary storage device;

an outlet valve for allowing fluid to flow to the container to be filled; and a coupling means for opening the outlet valve upon initial pressing of the container to be filled against the device and for moving the nozzle towards the inlet end of the temporary storage device upon subsequent pressing to thereby fit the valve disk in the valve seating.

6. The device as claimed in claim 5, wherein the outlet valve comprises:

an outlet tube through which liquid flows connected to the outlet plunger; and a valve ball connected to the nozzle and being positioned in the vicinity of an outlet of the outlet tube so that the outlet of the outlet tube is capable of resting on the valve ball to block passage of the fluid from the outlet tube.

7. The device as claimed in claim 6 wherein the coupling means comprises:

an outlet plunger movable within the nozzle in a direction which is coaxial with the direction of nozzle movement, the outlet plunger being biased to project from an outlet end of the nozzle opposite the inlet end of the nozzle, the outlet plunger being connected to the outlet tube so that when the outlet plunger and outlet tube are fully biased projecting from the outlet end of the nozzle, the valve ball is blocking the passage of liquid from the outlet tube; and a flange means connected to the outlet plunger for contacting the container to be filled so that when the container is initially pushed onto the device, the outlet plunger is moved against the bias force to open the outlet valve and upon further pushing the flange means contacts the nozzle to move the nozzle with the flange means towards the inlet end of the temporary storage device to close the inlet valve.

8. The device as claimed in claim 5, further comprising a movement control means for limiting nozzle motion so that the inlet end of the nozzle can only move partially to the outlet end of the temporary storage device.

9. The device as claimed in claim 5, further comprising:

a ventilation tube supplied on the inlet end of the temporary storage device projecting into the supply container;

an exterior vent connected to the ventilation tube; and a valve means on an end of the ventilation tube projecting into the supply container for opening when the pressure in the supply container is less than a predetermined value to allow air from the exterior vent to enter into the supply container.

10. A process of filling a container with a more or less viscous fluid using a container filling device, comprising the steps of:

(a) placing the container to be filled at least partially over an outlet of the filling device;

(b) primary pushing of an inlet of the container against a coupling means to thereby open an outlet valve which controls the flow of fluid between the device and the container;

(c) secondary pushing of the inlet of the container against the coupling means to push an plunger in an axial direction through a temporary storage device to thereby move a valve disk which is mounted on a drag link frictionally riding within a central bushing of the plunger into engagement with a valve seating to block a passage between the temporary storage device and a supply container;

(d) adjusting a screw to adjust the friction between a ring seal within the central bushing and the drag link;

(e) tertiary pushing of the inlet of the container against the coupling means to further move the plunger through the temporary storage device to and thereby slide the drag link through the plunger and cause fluid to flow through an opening in the plunger and into the container;

(f) removing the container to be filled from the device;

(g) allowing an outlet valve to close under a spring bias after the container has been removed; and (h) allowing the plunger to move in a direction opposite the direction moved in steps (c) and (d) under a bias force to thereby disengage the valve disk from the valve seating after the outlet valve is closed and then to draw fluid from the supply container into the temporary storage device.

11. A process of filling a container, as claimed in claim 10, further comprising the step of:

(i) allowing air to enter into the supply container through a ventilation tube when the pressure in the supply container is less than a predetermined value.

* * * * *